United States Patent [19]

Nakato et al.

[11] Patent Number: 4,635,703

[45] Date of Patent: Jan. 13, 1987

[54] COOLING PAD FOR USE IN A CONTINUOUS CASTING APPARATUS FOR THE PRODUCTION OF CAST SHEETS

[75] Inventors: Hakaru Nakato; Nagayasu Bessho; Tsutomu Nozaki; Yasuhiro Habu, all of Chiba; Tomoaki Kimura, Hitachi, all of Japan

[73] Assignees: Kawasaki Steel Corporation, Kobe City; Hitachi, Ltd., Tokyo, both of Japan

[21] Appl. No.: 762,965

[22] Filed: Aug. 6, 1985

[51] Int. Cl.[4] ..... B22D 11/124; B22D 11/06

[52] U.S. Cl. ..... 164/443; 164/485; 164/432

[58] Field of Search ..... 164/443, 431–433, 164/348, 128, 481, 482, 485

[56] References Cited

U.S. PATENT DOCUMENTS

| | | | |
|---|---|---|---|
| 3,933,193 | 1/1976 | Baker et al. | 164/432 |
| 4,061,177 | 12/1977 | Sivilotti et al. | 164/443 |
| 4,061,178 | 12/1977 | Sivilotti et al. | 164/443 |
| 4,193,440 | 3/1980 | Thorburn et al. | 164/432 |

FOREIGN PATENT DOCUMENTS

| | | | |
|---|---|---|---|
| 7801735 | 9/1978 | Netherlands | 164/431 |
| 616354 | 3/1980 | Switzerland | 164/432 |

*Primary Examiner*—Nicholas P. Godici
*Assistant Examiner*—Samuel M. Heinrich
*Attorney, Agent, or Firm*—Balogh, Osann, Kramer, Dvorak, Genova & Traub

[57] ABSTRACT

A cooling pad for use in a continuous casting apparatus for the production of cast sheets. The pad is provided with plural water supply and discharge holes satisfying the particular relations on the arrangement thereof. By using such a cooling pad, a filmy cooling water flow is uniformly and stably formed in the casting.

2 Claims, 7 Drawing Figures

COOLING PAD FOR USE IN A CONTINUOUS CASTING APPARATUS FOR THE PRODUCTION OF CAST SHEETS

BACKGROUND OF THE INVENTION

1. Field of the Invention and Related Art Statement

This invention relates to a filmy fluid (water) flow-forming pad (hereinafter referred to as a cooling pad) in a continuous casting apparatus for the direct production of cast sheets having a thickness of not more than 30 mm (e.g. sheet bar or the like) from molten metal, particularly molten steel (hereinafter referred to as a belt caster). More particularly, it relates to an improvement in the cooling pad which properly selects the size and arrangement of supply hole and discharge hole for cooling water so as to form a desired filmy water flow.

As a continuous casting apparatus for directly producing steel sheets such as sheet bar or the like from molten steel, there is a belt caster as disclosed in Japanese Patent laid open No. 57-100,851. In such a disclosed synchronous type belt caster, there are many systems, a typical example of which is shown in FIG. 1. This belt caster has usually such a structure that a casting space is defined by a pair of endlessly circulating metal belts 4, 5 oppositely arranged to each other at a given interval for retaining molten steel 2 over a predetermined distance, each of which being guided and supported through plural guide rolls *6a*, *6b*, *6c* or *6'a*, *6'b*, *6'c* and cooled by a filmy cooling water flow from the back face, and a pair of side plates disposed between the metal belts 4, 5 and positioned near the side edge portions of these metal belts.

Moreover, numeral 1 is a tundish, numeral 3 a pouring nozzle, numerals 7, 8 cooling pads arranged behind the metal belts 4, 5 for cooling these belts and forming a filmy water flow capable of supporting a static pressure of poured molten steel, numerals 9, 10 springs for tensioning the belts, and numeral 11 a cast sheet.

Since the static pressure of molten steel or semi-solidified cast sheet changes from molten steel level toward a cast sheet-drawing direction, the cooling pads 7, 8 act to balance the static pressure of molten steel at various stages of cast sheet (various positions in the cast sheet-drawing direction) by the pressure of the filmy cooling water flow. For this end, each cooling pad is provided at a side facing the respective metal belt with plural supply holes for the cooling water, each of which is provided at its top with a storing recess having a size enough to adjust the flow amount of the cooling water supplied.

In FIGS. 2 and 3 is shown a structure adopted in the conventional cooling pads 7 and 8, wherein each of plural oblong recesses 12 is disposed on the top portion of the corresponding water supply hole 15 for injecting the cooling water, which hole being formed in each of the cooling pads at its side facing the metal belt 4, 5, whereby a film flow of the cooling water is formed between the metal belt 4 or 5 and the cooling pad 7 or 8 to meet static pressure of molten steel and to uniformly cool the metal belt. Moreover, the oblong recesses 12 have usually a minor axis *a* of 50–150 mm and a major axis *b* of 100–200 mm and are so arranged that a transverse distance ($l_1$) between centers of minor axes of mutual recesses is 200–400 mm and a longitudinal distance ($l_2$) between centers of major axes of mutual recesses is 200–600 mm.

In the conventional cooling pad of such a structure, if it is intended to continuously cast thin slabs and sheet bars, the flow rate of the cooling water is considerably different between the water flowing portion 14 formed in the recess 12 and the filmy water portion 13 formed in an area other than the recess, so that there is caused the difference in the cooling strength, resulting in the wavy deformation of the metal belt. As a result, the liquid-tight contacting between the metal belt 4, 5 and the fixed side plate is injured to produce a gap therebetween, which causes the leakage of molten steel, casting troubles, and production of cast sheet having a poor shape such as fin and the like. And also, the surface of the cast sheet is not smoothened, which affects the surface properties of thin steel sheet after the rolling to cause the deterioration of the quality.

SUMMARY OF THE INVENTION

It is, therefore, an object of the invention to overcome the drawback of the conventional cooling pad, wherein the rear surface of the metal belt is cooled by the filmy water portion 13 and the water flowing portion 14, by an arrangement of water supply hole and water discharge hole for forming a filmy cooling water flow so as to match static pressure of molten steel as mentioned later and to prevent the occurrence of accidents in the casting operation and the deterioration of qualities in the cast products.

According to the invention, there is provided a cooling pad for use in the belt caster provided at a side facing the metal belt with plural water supply and discharge holes of particular size and arrangement.

DETAILED DESCRIPTION OF THE INVENTION

Figure 1:
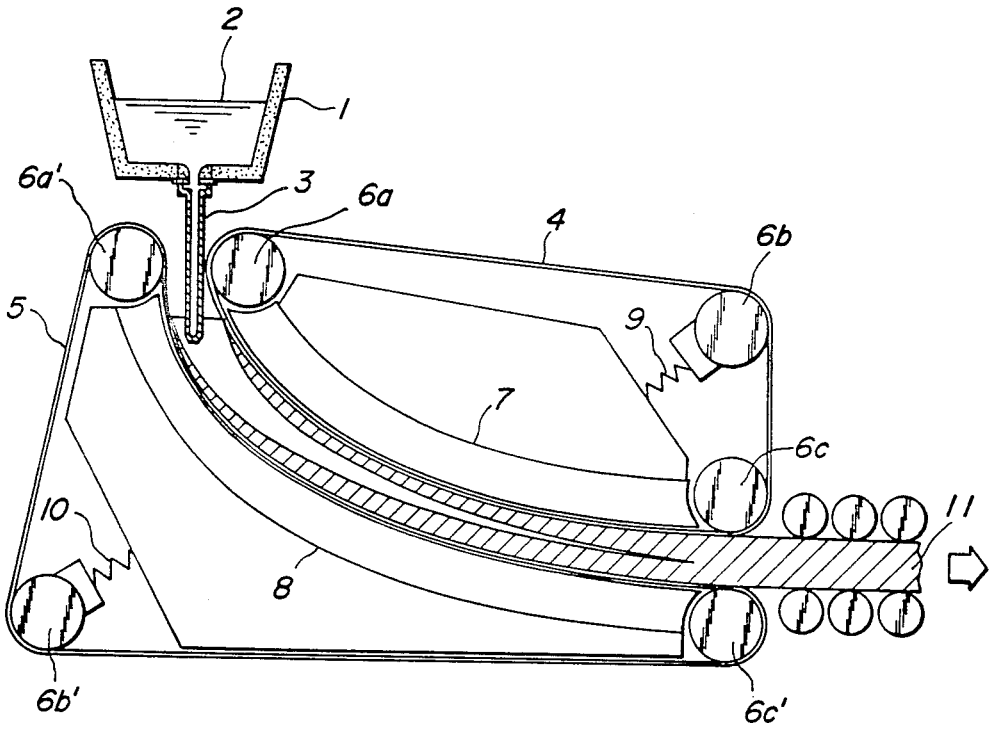
FIG. 1 is a schematic view of an embodiment of the continuous casting apparatus for the direct production of cast thin sheets.

According to the invention, plural water supply holes 15 and plural water discharge holes 16 opening to the metal belt 4 or 5 are simultaneously disposed on each of the cooling pads 7 and 8 in the continuous casting apparatus, and the size and arrangement thereof are characterized by satisfying the following requirements as a result of the observation of flow velocity distribution of filmy cooling water flow and the measurement of the heat transfer coefficient in model experiments and actual operation:

(1) The water suppy holes 15 are uniformly dispersed as far as possible facing the rear surface of the metal belt 4 or 5;

(2) The water discharge holes 16 are symmetrically disposed around each water supply hole 15;

(3) The cross sectional area of the water supply hole Ai ($cm^2$) and the cross sectional area of the water discharge hole Ao ($cm^2$) satisfy the following equation:

$$Ai/Ao > \alpha n \quad (1)$$

Figure 4:
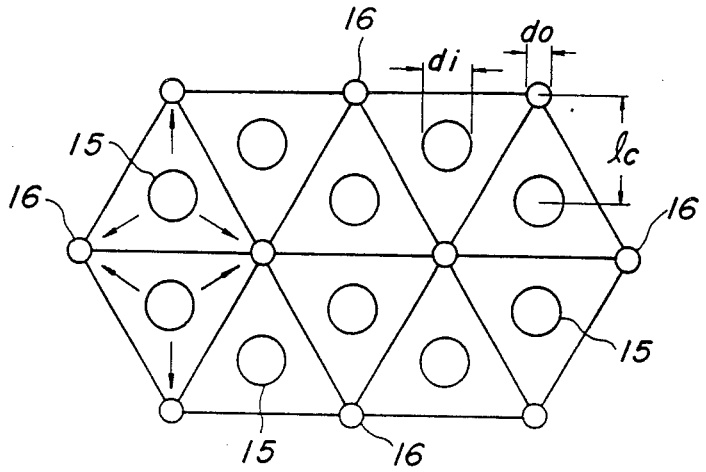
FIGS. 4 to 6 are schematic views of embodiments on the arrangement of water supply and discharge holes in the cooling pad according to the invention, respectively.
Figure 5:
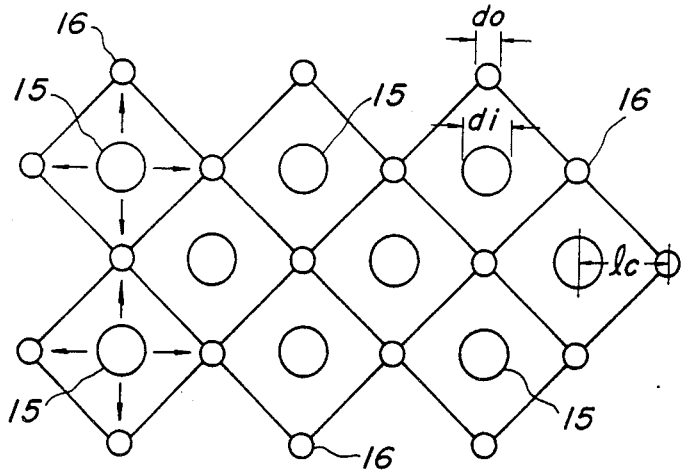
Figure 6:
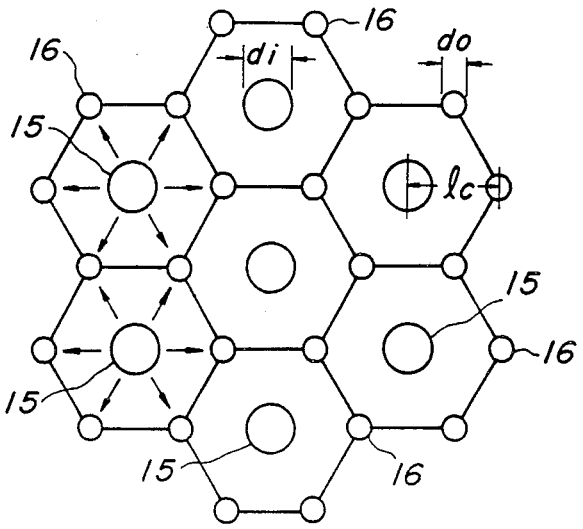

, wherein n is a parameter depending upon the arrangement of the water supply and discharge holes. That is, when the arranging shape of the water discharge holes is triangular, n is 0.5. Further, n is 1 in case of the square shape and 2 in case of the hexagonal shape. Such arranging shapes are shown in FIGS. 4–6.

Figure 7:
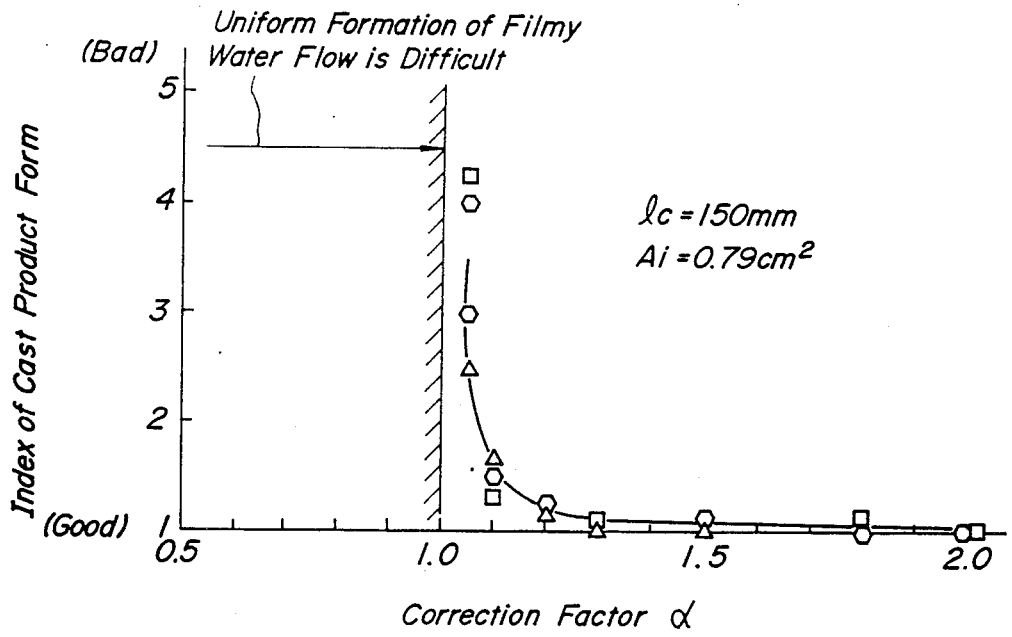
FIG. 7 is a graph showing an influence of correction factor in sectional area ratio of water supply hole to water discharge hole on index of cast sheet form.

And also, $\alpha$ is a correction factor in a sectional area ratio of water supply hole to water discharge hole. If $\alpha < 1$, the uniform formation of the filmy water flow is difficult and there is occasionally caused the melting loss of the metal belt during the casting. In order to uniformly and stably form the filmy water flow having a thickness of about 300 to 2,000 μm, $\alpha$ is necessary to be not less than 1.1, preferably not less than 1.2 as shown in FIG. 7, in which Δ represents triangular arrangement, □ represents square arrangement and represents hexagonal arrangement;

(4) When the sectional area Ai ($cm^2$of the water supply hole 15 is less than 0.5, the clogging of the hole is apt to be caused due to the adhesion of scales, while when it exceeds 7, stagnation is produced in the water flow. Therefore, the sectional area Ai is necessary to satisfy the following relation:

$$0.5 < Ai < 7;$$

and (5) The distance lc between the centers of the water supply hole and the water discharge hole is necessary to be $lc \leqq 20$ cm, preferably $lc \leqq 17.5$ cm because it is difficult to ensure the uniform formation of the filmy water flow distribution as the value of lc becomes large.

Although the symmetricalness is lost or some of the above requirements are not satisfied in the circumferential portion of the cooling pad, it is not an important subject because the metal belt corresponding to the circumferential portion of the cooling pad does not directly cool the cast sheet. Further, the arrangement of the water discharge holes determining the value of n is not necessary to be exactly held at the triangular shape or the like, and can be changed to such an extent that a large change of heat flow distribution is not caused. Moreover, the invention is applicable to not only belt caster comprising a pair of fixed side plates but also belt caster comprising a pair of side plates synchronously moving with the metal belts.

The following examples are given in illustration of the invention and are not intended as limitations thereof.

Example 1

A continuously cast sheet of low-carbon aluminum killed steel having a thickness of 100 mm and a width of 500 mm was produced through the belt caster shown in FIG. 1, wherein each of the cooling pads 7, 8 used was provided with plural water supply and discharge holes 15, 16 having a sectional area of water supply hole Ai = 1.1 $cm^2$ (hole diameter di = 12 mm), a sectional area of water discharge hole Ao = 0.38 $cm^2$ (hole diameter do = 7 mm), a distance between water supply and discharge holes lc = 12 cm and n = 2 (hexagonal shape shown in FIG. 6). In this operation, the temperature of molten steel 2 in the tundish 1 was 1,560° C. and the maximum drawing speed was 3.0 m/min. As the metal belt 4 or 5 was used a thin steel having a thickness of 1.2 mm.

Figure 2:
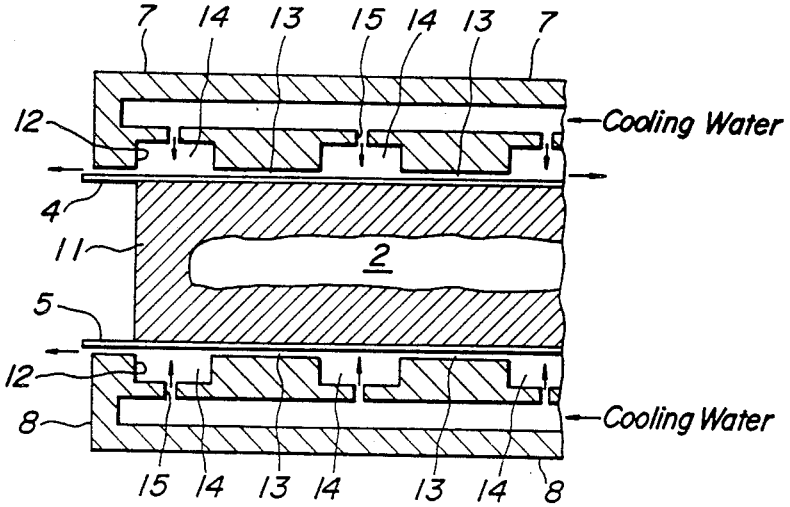
FIG. 2 PRIOR ART
FIG. 2 is a partially sectional view of the conventional cooling pad as mentioned above.
Figure 3:
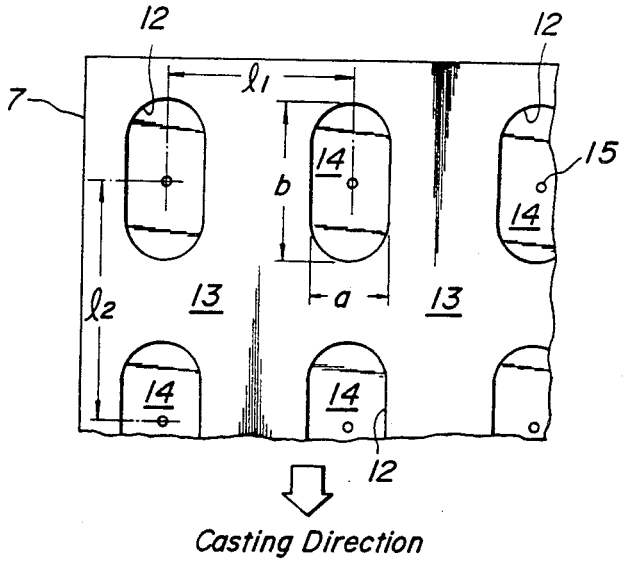
FIG. 3 PRIOR ART
FIG. 3 is a partially plan view of the conventional cooling pad viewed from the metal belt.

The resulting cast sheet, after the cooling from the back surface of the metal belt using the above cooling pad was even and smooth at its surface as compared with the cast sheet obtained by using the conventional cooling pad shown in FIGS. 2 and 3, from which was obtained a rolled thin steel sheet having a beauty surface. Even after the casting of about 30 tons, the metal belt was normal and did not produce the deformation and the formation of fin accompanied therewith.

EXAMPLE 2

The same procedure as described in Example 1 was repeated, except that the arrangement of water supply and discharge holes in the cooling pad had Ai = 0.79 $cm^2$ (di = 10 mm), Ao = 0.79 $cm^2$ (do = 10 mm), lc = 10 cm and n = 0.5 (triangular shape), to produce a cast sheet, which was subjected to a usual rolling treatment to obtain a thin steel sheet of 1.2 mm in thickness. In this case, the surface of the cast sheet was smooth, and the surface properties of the thin steel sheet were excellent.

EXAMPLE 3

A continuously cast sheet of aluminum killed steel having a thickness of 30 mm and a width of 1,000 mm was produced through a belt caster comprising a converged-type side face tapering toward the casting direction and a cooling pad having that arrangement of water supply and discharge holes which has Ai = 3.1 $cm^2$ (di = 20 mm), Ao = 0.79 $cm^2$ (do = 10 mm), lc = 17.5 cm and n = 1 (square shape). The maximum drawing speed was 5.3 m/min. As a result, the obtained sheet bar was good in the shape and surface properties likewise the cases of Examples 1 and 2.

COMPARATIVE EXAMPLE 1

A continuously cast sheet of aluminum killed steel having a thickness of 30 mm and a width of 1,000 mm was produced at a drawing speed of 4.7 m/min through a converged-type belt caster, wherein the arrangement of water supply and discharge holes in the cooling pad had Ai = 3.1 $cm^2$ (di = 20 mm), Ao = 0.79 $cm^2$ (do = 10 mm), lc = 23 $cm^2$ and n = 1 (square shape). In this case, only the distance between holes lc was outside the range defined in the invention (lc < 20 cm). When the inner surface of the steel belt having a thickness of 1.2 mm was observed after the casting of about 5 tons, unevenness was locally produced, so that it was obliged to replace the steel belt with a new steel belt.

As mentioned above, according to the invention, the filmy cooling water flow can uniformly and stably be formed on the rear surface of the metal belt, whereby the cooling unevenness of the belt can be solved and hence the wavy deformation of the belt is prevented. As a result, the contacting of the metal belt with the fixed side plate is improved, whereby not only the accidents in the casting can be avoided, but also the qualities of the cast sheet and finished sheet are improved.

What is claimed is:

1. In a continuous casting apparatus for the production of cast sheets comprising a pair of endlessly circulating metal belts oppositely arranged at such a gap to hold molten metal and its cast sheet at both long sides of the cast sheet, a pair of side plates each locaed near the both side edge portions of the belts and brought into intimate contact therewith, and a cooling pad for supplying and discharging a cooling water to the rear surface of the metal belt, the improvement wherein said cooling pad is provided with plural water supply holes and water discharge holes each opening to said metal belt so as to satisfy the following relations:

$0.5 \leqq Ai \leqq 7$ $Ai/Ao \leqq 1.1$ in $lc \leqq 20$, wherein Ai is a sectional area ($cm^2$) of the water supply hole, Ao is a sectional area ($cm^2$) of the water discharge hole, n is a parameter depending on the arrangement of the water supply and discharge holes, and lc is a distance (cm) between the centers of the water supply hole and the water discharge hole, said water dischrge holes being disposed around said water supply hole in said cooling pad into a triangular shape at $n=0.5$, a square shape at $n=1$ or a hexagonal shape at $n=2$.

2. The continuous casting apparatus according to claim 1, wherein said distance between the centers of the water supply and discharge holes is $lc<17.5$.

* * * * *